United States Patent [19]

Keritsis et al.

[11] Patent Number: 5,012,823

[45] **Date of Patent: * May 7, 1991**

[54] TOBACCO PROCESSING

[75] Inventors: Gus D. Keritsis; Jose G. Nepomuceno; Douglas E. Albertson; Lewis A. Haws, all of Richmond, Va.

[73] Assignee: Philip Morris Incorporated, New York, N.Y.

[ * ] Notice: The portion of the term of this patent subsequent to Oct. 28, 2003 has been disclaimed.

[21] Appl. No.: 92,124

[22] Filed: Sep. 2, 1987

Related U.S. Application Data

[63] Continuation-in-part of Ser. No. 901,447, Aug. 28, 1986, abandoned, which is a continuation-in-part of Ser. No. 637,259, Aug. 3, 1984, Pat. No. 4,619,276.

[51] Int. Cl.[5] ..... A24C 5/00; A24C 5/14; A24C 5/18

[52] U.S. Cl. ..... 131/31; 131/62; 131/79; 131/84.1; 131/88

[58] Field of Search ..... 131/62, 63, 78, 88, 131/79, 280, 31, 84.1

[56] References Cited

U.S. PATENT DOCUMENTS

| | | |
|---|---|---|
| Re. 31,625 | 7/1984 | Kaspers et al. . |
| 236,510 | 1/1881 | Pacholder . |
| 973,768 | 10/1910 | Evers . |
| 1,961,866 | 6/1934 | Rooker . |
| 1,972,718 | 9/1934 | Sharlit . |
| 2,067,338 | 1/1937 | Power et al. . |
| 2,217,527 | 10/1940 | Roon . |
| 2,617,426 | 11/1952 | Patterson . |
| 3,012,915 | 12/1961 | Howard . |
| 3,402,722 | 9/1968 | Kochalski . |
| 3,404,690 | 10/1968 | Moshy et al. . |
| 3,410,279 | 11/1968 | Moshy et al. . |
| 3,611,635 | 10/1971 | Tanaka et al. . |
| 3,732,872 | 5/1973 | Lakritz . |
| 3,773,055 | 11/1973 | Stungis et al. . |
| 3,817,258 | 6/1974 | Ernow . |
| 3,834,398 | 9/1974 | Briskin et al. . |
| 3,847,162 | 11/1974 | Seil . |
| 3,872,871 | 3/1975 | Fiore et al. . |
| 3,931,824 | 1/1976 | Miano et al. . |
| 4,099,913 | 7/1978 | Walter et al. . |
| 4,147,172 | 4/1979 | Calder et al. . |
| 4,186,754 | 2/1980 | Labbe . |
| 4,233,993 | 11/1980 | Miano et al. . |
| 4,341,228 | 7/1982 | Keritsis et al. . |
| 4,409,995 | 10/1983 | Nichols . |
| 4,451,282 | 5/1984 | Knops et al. . |
| 4,457,319 | 7/1984 | Lamb et al. . |
| 4,457,774 | 7/1984 | Eue et al. . |
| 4,457,870 | 7/1984 | Schröder et al. . |
| 4,457,930 | 7/1984 | Schmitt et al. . |
| 4,619,276 | 10/1986 | Albertson et al. . |
| 4,785,831 | 11/1988 | Hinchcliffe et al. . |

FOREIGN PATENT DOCUMENTS

| | | |
|---|---|---|
| 953728 | 4/1964 | United Kingdom . |
| 1013303 | 12/1965 | United Kingdom . |
| 1194572 | 6/1970 | United Kingdom . |
| 1257290 | 12/1971 | United Kingdom . |
| 1508616 | 4/1978 | United Kingdom . |
| 1561706 | 2/1980 | United Kingdom . |
| 2090774 | 7/1982 | United Kingdom . |
| 2119628 | 11/1983 | United Kingdom . |
| 2128873 | 5/1984 | United Kingdom . |
| 2163339 | 2/1986 | United Kingdom . |

OTHER PUBLICATIONS

The Condensed Chemical Dictionary, 392–393 (G. Hawley, 9th ed. 1977).

*Primary Examiner*—V. Millin

*Attorney, Agent, or Firm*—Jeffrey H. Ingerman

[57] ABSTRACT

A method and apparatus are disclosed for applying foamed material to tobacco, and for drying and setting the foamed material, particularly in connection with the making of cigarettes. The foamed material may be added to the tobacco, for example, in the paper guide section of a cigarette maker, at the garniture mouth or through the short tongue or through both, or at the chimney. Drying and setting can occur in the chimney, on the vacuum belt, or in the garniture, after the material has been applied to the tobacco filler. Drying can be accomplished, for example, by using heated air or microwave radiation. Addition of material to tobacco filler, during the cigarette making process in the form of a foam, results in a cigarette in which the material added is more uniformly distributed.

10 Claims, 13 Drawing Sheets

FIG. 5
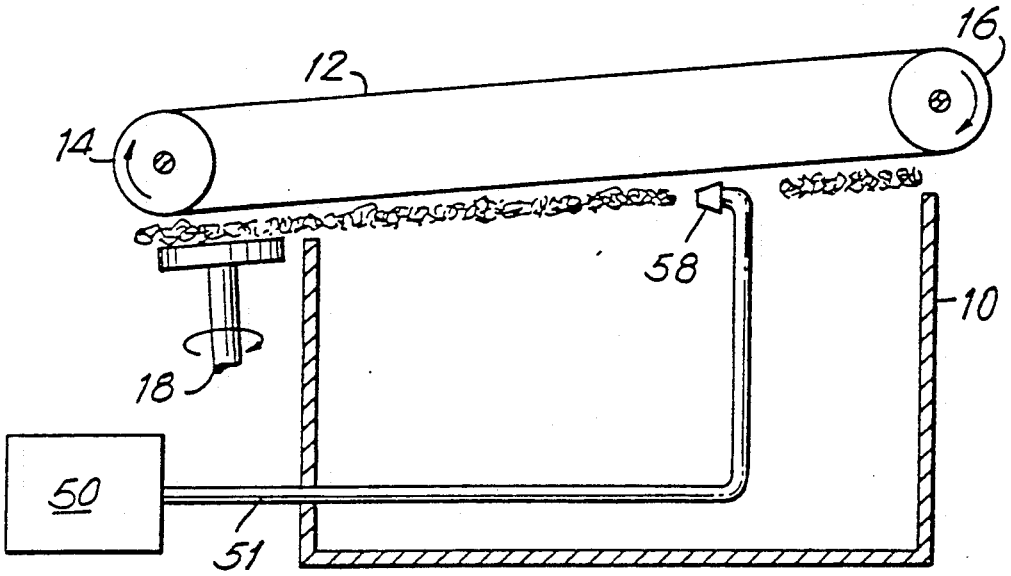
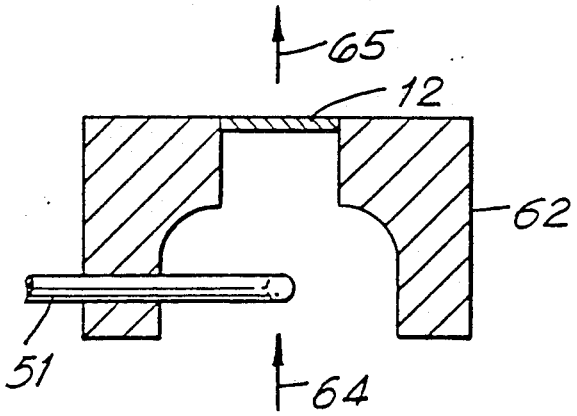
FIG. 5A

TOBACCO PROCESSING

CROSS-REFERENCE TO RELATED APPLICATIONS

This application is a continuation-in-part of copending United States patent application Ser. No. 901,447, filed Aug. 28, 1986, now abandoned which was a continuation-in-part of application Ser. No. 637,259, filed Aug. 3, 1984, now U.S. Pat. No. 4,619,276.

BACKGROUND OF THE INVENTION

This invention relates to apparatus and method for processing tobacco, and more particularly to applying a liquid additive foam to tobacco filler in the course of cigarette manufacturing.

During cigarette manufacturing, various materials may be added to tobacco filler to vary certain characteristics of the finished cigarette. The material most frequently added to the tobacco filler is flavoring. It is important that the material added to the tobacco filler be uniformly distributed throughout a given batch of filler so that all of the cigarettes produced from that batch are virtually identical. It is also important that the material be added uniformly so that an individual cigarette has consistent smoking characteristics from the first puff until the last puff.

Prior attempts to achieve uniform distribution of material added to tobacco filler have involved treating the tobacco filler early in the manufacturing process prior to delivering the filler to the cigarette making machine. However, when material is added early in the manufacturing process, some of the material may be lost during further processing, especially if the material added is volatile. In addition, some of the material may rub off in the cigarette making machine and foul up the cigarette making machine, causing it to be shut down periodically for cleaning. Shutting down the cigarette making machine for cleaning is expensive both because of the labor cost required for cleaning the machine and because of lost production time. Because many of the flavors added to cigarettes are expensive, loss of flavoring material, either because of its volatility or through build-up in the machine, can also be expensive.

It is desirable, therefore, to add the material to the tobacco filler late in the manufacturing process, preferably at the cigarette making machine itself, and in a uniform manner. Known methods of adding material at the maker have failed to achieve uniform distribution of the applied materials. For example, if material is added at the short tongue of the cigarette maker as in Nichols U.S. Pat. No. 4,409,995, the added material may be distributed in a uniform manner per unit length along the length of cigarette rod, but some of it may be concentrated on one side of the cigarette rod rather than being distributed throughout the cross section of the rod. If the material added is liquid, adding it in this manner may also result in streaking of the cigarette wrapper.

Further, it often is necessary to add only a minute quantity of material to the tobacco filler. In the past when this has been done, either at the cigarette making machine or earlier in the cigarette manufacturing process, the material has been applied as a dilute solution added to the tobacco filler. If such a solution is added at the cigarette making machine, as discussed, for example, in British patent application 2 128 873, which discloses the addition of a bonding agent in liquid form to smoking material, the excess liquid will often result in streaking of the cigarette wrapper, as discussed above. If the solution is added early in the manufacturing process, excess solution must be removed from the filler by drying, which results in additional expense.

In above-identified grandparent application Ser. No. 637,259, filed Aug. 3, 1984, now U.S. Pat. No. 4,619,276, it was disclosed that an additive material could be applied to the tobacco stream in a cigarette making machine as a liquid additive foam, either in the chimney—particularly in the belt guide section of the chimney, as the tobacco is deposited on the moving garniture tape, between the ecreteur and the short tongue, or at the short tongue. It was also disclosed that the liquid additive foam could be injected into the tobacco rod of a finished cigarette by injecting it through the end of the tobacco rod using a needle.

Because the additive material is applied as a foam, according to said copending application, a small amount could be more uniformly applied over a large amount of tobacco. Further, much less liquid or solvent need be used as compared to earlier methods of applying additive material.

However, even the small amount of liquid used in the liquid additive foam may mar the wrapper of a finished cigarette made with the treated tobacco filler. Further, where the liquid additive foam is a binder, intended to increase the firmness of the finished cigarette, if the filler is compressed to make the cigarette before the foam has set, the full firmness-increasing effect of the binder may not be realized.

It would be desirable to be able to dry and set a liquid additive foam that has been added to tobacco filler in a cigarette making machine, said drying and setting occurring prior to the incorporation of the filler into a finished cigarette.

SUMMARY OF THE INVENTION

It is therefore an object of this invention to be able to dry and set a liquid additive foam that has been added to tobacco filler in a cigarette making machine, said drying and setting occurring prior to the incorporation of the filler into a finished cigarette.

In accordance with this invention, there is provided apparatus for manufacturing cigarettes comprising a cigarette maker having means for providing a moving stream of tobacco, an inlet chimney for receiving cut tobacco filler, an ecreteur section, and a garniture, movable garniture tape and short tongue for forming said filler into a cigarette rod. The apparatus also comprises means for producing a liquid additive foam, means for applying said liquid additive foam to said moving stream of tobacco, and means for drying and setting said applied liquid additive foam.

A cigarette manufacturing method according to this invention comprises providing a moving stream of tobacco, producing a liquid additive foam, applying said liquid additive foam to said moving stream of tobacco, and drying and setting said applied liquid additive foam.

The present invention involves treating tabacco filler with a flavoring or other material applied in the form of a liquid additive foam. By using a liquid additive foam, the filler can be impregnated thoroughly due to the exceptional penetrating ability of foam. The low density of foam also enables application of materials in a quantity sufficient to permeate the filler without staining the cigarette wrapper. The liquid additive foam may be added to the filler either in the chimney of a cigarette maker, before the tobacco leaves the vacuum belt, as the tobacco drops off the vacuum belt, at the short tongue, or at any other suitable location prior to enclosing the tobacco rod in a wrapper. Where the liquid additive foam is applied before the short tongue, the treated filler can be dried and set by the application of hot air, ambient temperature air, reduced humidity ambient temperature air, or microwave radiation. The liquid additive foam may also be applied to the tobacco filler prior to transporting the filler to a cigarette maker or it may be applied to finished cigarettes through a hollow tube.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which:

FIG. 5 is a vertical cross-sectional view of the chimney section of a cigarette making machine according to a second embodiment of the invention;

FIG. 5A is a vertical cross-sectional view of the guide block portion of the chimney looking from right to left in FIG. 5;

DETAILED DESCRIPTION OF THE INVENTION

The invention will now be described with reference to the drawings in which a number of representative embodiments of the present invention, some of which are particularly preferred, are disclosed. Although the foam material discussed throughout the remainder of the specification is an adhesive foam, it has been found that virtually any foamed material, such as, for example, film-forming or cross-linking agents, binders, burn additives, casings or flavors, can be applied in the manner described, thereby enhancing the uniformity of distribution of the material throughout the tobacco filler.

In general, a foamed adhesive useful in accordance with the invention consists of a gas and a liquid adhesive. The liquid adhesive may comprise a foaming agent or a foam stabilizing agent, or a binder such as, for example, a film-forming material or a cross-linking agent, or combinations thereof, with or without an emulsifying agent.

Generally, the types of film-forming material which are applicable to and which may be employed in the present invention include polymers charides and their derivatives, synthetic thermoplastic film-formers and the like, and pastes or other derivatives obtained from natural products such as tobacco, or extracts thereof, or extracellular material from cultured tobacco cells, either with or without the cells themselves.

Typical polysaccharides, polysaccharide derivatives, and synthetic film-formers are disclosed in U.S. Pat. 4,341,228, which is hereby incorporated by reference in its entirety. Inorganic binders such as silicates, bentonite, etc., may also be used.

Typical foaming agents include saponines, caseinates, hydrolized proteins, soaps, sodium lauryl sulfate, polyglycerol esters, and lactated esters and combinations thereof.

Although the specific cigarette making machine discussed in this specification is the Mk8 Cigarette Maker, manufactured by the Molins Company, foamed materials may be applied to tobacco filler, or any suitable tobacco substitute, in virtually any commercially available cigarette making machine. Further, foamed material may be applied to any smoking article, such as cigars, or even nontobacco smoking articles.

Figure 1:
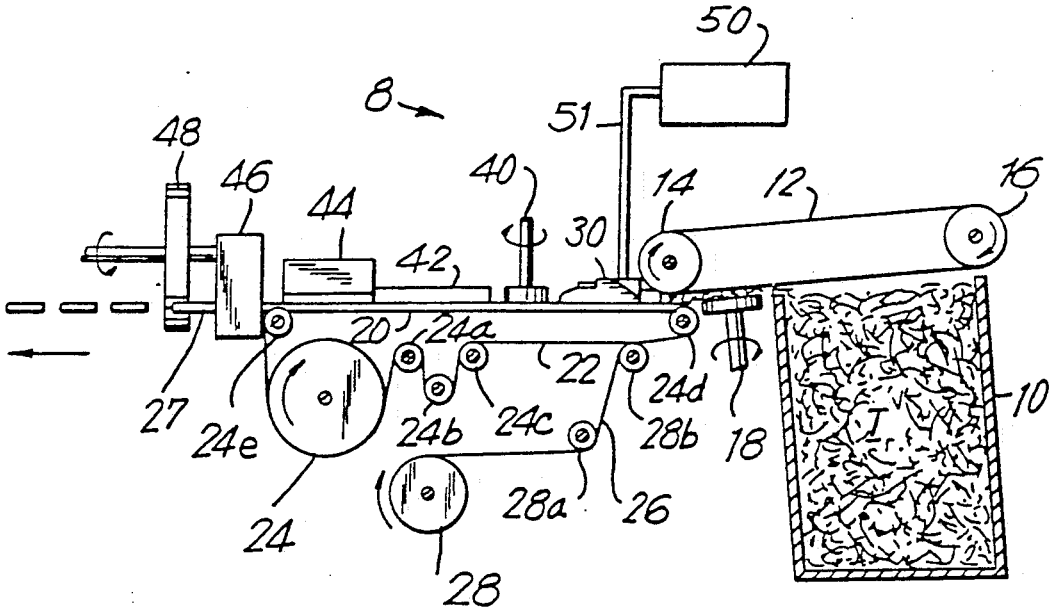
FIG. 1 is a schematic side elevational view of a cigarette making machine according to the present invention.

In FIG. 1 there is illustrated a cigarette making apparatus known as the Mk8 Cigarette Maker designated generally by reference numberal 8. Cigarette maker 8 is shown schematically to include tobacco chimney 10 from which tobacco T is blown onto a perforated vacuum belt 12 driven by rollers 14, 16, to convey tobacco T, supported by belt 12, to ecreteur or trimmer knife assembly 18 supported for movement toward or away from the conveyed tobacco to vary the amount of tobacco on belt 12 in accordance with a cigarette weight- or density-based control signal.

Figure 4:
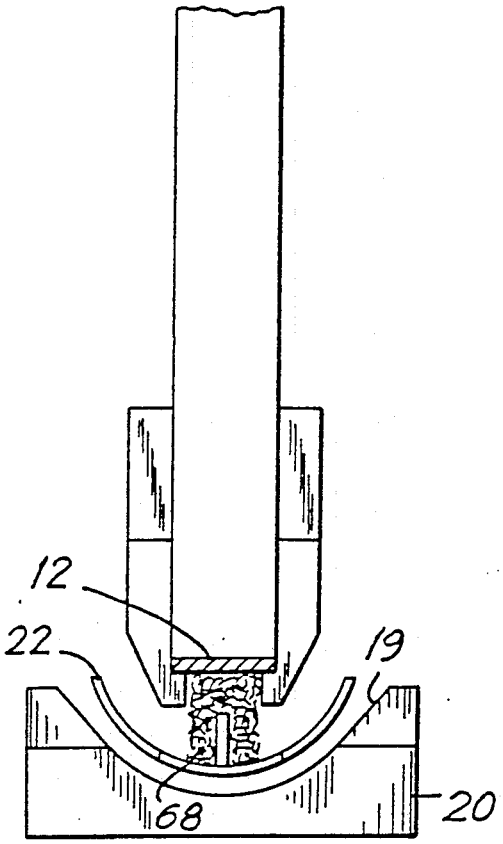
FIG. 4 is a cross-sectional view of the paper guide section of FIG. 3, taken from line IV—IV of FIG. 3.

To the left of roller 14, cigarette maker 8 includes an elongated garniture 20 defining an open channel 19, shown in FIG. 4, extending longitudinally in a generally semi-cylindrical configuration. Endless garniture tape or belt 22 is fed to the upstream tobacco inlet mouth 21 of garniture 20 and transported through garniture 20 by drive wheel 24 over idler rollers 24*a–e*. Cigarette paper 26 is fed to mouth 21, and to garniture tape 22, from supply bobbin 28, over idler rollers 28*a, b*, 24*d*. Tobacco falls from belt 12 onto paper 26 as the vacuum applied to the belt is removed. On entry of garniture tape 22 into garniture channel 19, the garniture imparts generally semi-cylindrical shape to tape 22, a like shape being imparted to paper 26 and tobacco T deposited thereon from belt 12. Foam discharge nozzle 68, shown in FIG. 2, is located above garniture tape 22 in the vicinity in which tobacco is released from vacuum belt 12.

Figure 2:
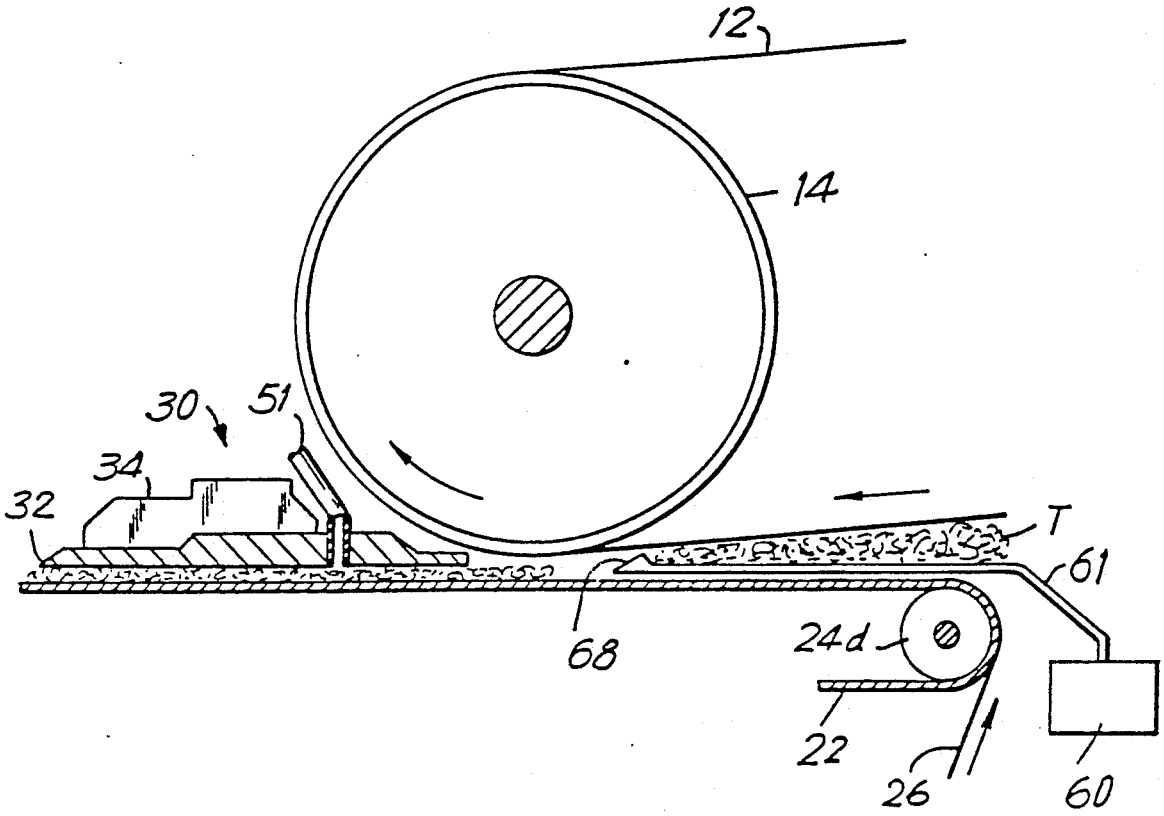
FIG. 2 is a vertical cross-sectional view of the paper guide section and the short tongue of the cigarette making machine of FIG. 1.

Short tongue 30, shown in more detail in FIG. 2, has a compression foot 32 mounted on arm 34. Compression foot 32 is cooperative with garniture 20, shown in FIG. 1, to impart a generally cylindrical form to the tobacco filler to form tobacco rod 27. To this end, compression foot 32 defines an open channel of generally semi-cylindrical configuration extending longitudinally, the open semi-cylindrical configuration of such channel being opposite that of the garniture and complementary thereto. Foam generator 50 supplies foamed adhesive through piping 51 through compression foot 32 to the tobacco as it is being formed into a rod.

As a formed tobacco rod 27 leaves short tongue 30, a length of cigarette paper extends tangentially from the paper-wrapped rod. Paster wheel 40, shown in FIG. 1, applies an adhesive to the extending length of paper, folder unit 42 folds the pasted length over the opposite end of the wrapper and unit 44 heat seals rod 27. Sealed, continuous rod 27 passed through a nuclear density gauge 46 and is then cut into cigarette lengths or small multiples thereof by rod cut-off mechanism 48.

Referring now to FIG. 2, there is shown a longitudinal sectional view of short tongue 30 and the paper guide section. Foam generator 60 supplies foamed adhesive through piping 61 to nozzle 68 which is located above garniture tape 22. Tobacco T is transported by vacuum belt 12 to a position above garniture tape 22. As vacuum is released from belt 12, the tobacco is showered onto paper 26 which is carried on garniture tape 22. Foam from nozzle 68 is dispersed throughout the loose tobacco as it falls onto paper 26.

Referring again to FIG. 1, as the tobacco is transported through cigarette maker 8 by garniture tape 22, a general cylindrical shape is imparted to the tobacco by tape 22 in combination with garniture 20. As the tobacco passes under short tongue 30, which has a semi-cylindrical shape complementary to the shape of the garniture 20, the tobacco is further compressed and formed into a rod. Foam generator 50 supplies additional foamed adhesive through pipe 51 into the tobacco as it passes under compression foot 32 of short tongue 30. Adhesive foam may be applied through nozzle 68 only or through pipe 51 only and still achieve suitable dispersion within the loose tobacco. However, applying foamed adhesive through both nozzle 68 and pipe 51 gives greater assurance that the foamed adhesive has completely penetrated the rod of tobacco.

Figure 3:
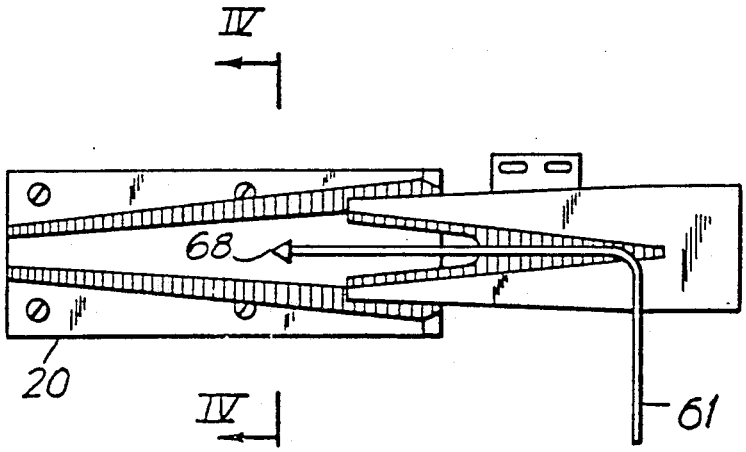
FIG. 3 is a horizontal cross-sectional view of the paper guide section of the cigarette making machine of FIG. 1.

FIG. 3 shows a longitudinal cross section, seen from above, of the paper guide section of FIG. 2. The location of adhesive foam piping 61 and nozzle 68 with respect to the center line of garniture 20 is more clearly shown in this view.

FIG. 4 shows a cross-sectional view of nozzle 68 and garniture 20 looking from chimney 10 toward short tongue 30, taken along line IV—IV of FIG. 3.

Adhesive foam may also be applied to the tobacco in chimney 10 as it is drawn onto vacuum belt 12, as shown in FIG. 5. As tobacco is drawn upward and accumulates on vacuum belt 12, foamed adhesive is applied from the foam generator 50 to piping 51 to nozzle 58. Although nozzle 58 may be located at various distances from vacuum belt 12, it has been found that at a distance of approximately one inch from vacuum belt 12, foamed adhesive is distributed uniformly throughout the tobacco. The distance of nozzle 58 from vacuum belt 12 will vary depending on whether the foam is injected parallel to the vacuum belt 12, as in FIG. 5, or perpendicular to belt 12 (not shown). When the foam is injected parallel to belt 12, the nozzle may be closer.

FIG. 5A shows a cross-sectional view of the belt guide area of chimney 10 looking from right to left as shown in FIG. 5. Tobacco T is carried upward pneumatically in the direction indicated by arrow 64 and is deposited on vacuum belt 12. The air stream continues upward as shown by arrow 65. Belt 12 carries tobacco in a direction into the plane of the figure. Pipe 51 carries foam through belt guide 62 to the approximate center line of vacuum belt 12. Among the center line of vacuum belt 12, pipe 51 bends downstream (into the plane of the figure) so that it is parallel to vacuum belt and guide block 62. It has been found that by injecting foam in a direction parallel to the direction of motion of belt 12, tobacco builds up around nozzle 58, shown in FIG. 5, protecting the components of chimney 10 from being fouled by foamed material.

EXAMPLE

Foamed adhesive was added to tobacco through a nozzle in the chimney section as described above. The foam was produced by a Laboratory Foam Finishing System available from Gaston County Dyeing Machine Company, Stanley, N.C. This type of foam generator produces foamed adhesive by using a beater or rotor and stator to mix the gas, in this case air, and the liquid adhesive. The density of the foamed adhesive may be altered by adjusting the ratio of liquid adhesive to gas. An acceptable ratio for the density of foamed adhesive would be from about 0.02 grams/cc to about 0.30 grams/cc. The density of the adhesive used in this test run was 0.08 grams/cc, corresponding to a liquid-to-air ratio of 1:12.5 by volume. The composition of the liquid adhesive was 25 percent dextrin, 2 percent methylcellulose, 1.5 percent sodium lauryl sulfate, and the balance water. The flow rate of the adhesive depends on the speed of the maker and the application rate desired. In this example, at a cigarette maker speed of 2000 cigarettes per minute, the flow rate of foam with 28.5% solids was adjusted to 80 grams/ minute to obtain an adhesive application of approximately 1.5 percent by weight.

In the Table below, the data appearing under the column headed Conventional Cigarette are comparative and represent typical values for cigarettes manufactured in a conventional manner without the use of foamed adhesive.

TABLE

| Characteristics | 1 Conventional Cigarette | 2 Cigarette with Foamed Adhesive | 3 Cigarette with Foamed Adhesive |
|---|---|---|---|
| weight of tobacco per cigarette (g) | 0.741 | 0.744 | .708 |
| firmness* (mm 10) | 34.0 | 31.4 | 33.7 |
| coal strength (%)** | 33.0 | 23.0 | 28 |
| loose ends | 0.68 | 0.27 | 0.31 |

TABLE-continued

| Characteristics | 1 Conventional Cigarette | 2 Cigarette with Foamed Adhesive | 3 Cigarette with Foamed Adhesive |
|---|---|---|---|
| (g/50 cigarettes)*** | | | |

*Firmness is measured by placing 15 cigarettes in 3 levels of 6, 5, and 4 in a holder having trapezoid-shaped shoe of fixed area. The filled cigarette holder is placed under a compression device in such a way so that the compression plate is properly placed to make contact with the center 40 mm section of the four cigarette rods directly in contact with the plate. The cigarettes are initially compressed with a 100 g plate weight to 0.04 mm value until they stabilize in place. At this time, an additional weight of 1400 g is automatically dropped by an electromagnet. At the end of 30 seconds, the compression value [units?] is automatically recorded which is indicative of cigarette firmness.

**Coal strength is the total number of coals removed from 100 cigarettes, expressed as a percentage. The cigarettes are tested by subjecting lighted cigarettes to a three inch drop at the rate of 20 to 21 drops per minute for one minute. The cigarettes are then repuffed and the procedure repeated for another minute. The procedure is repeated a third time and a fourth time. At the end of the fourth testing, all cigarettes whose coals have fallen off are counted. The coal is considered to have been removed if at least two-thirds of the coal has fallen off.

***Loose ends are measured by tumbling 50 cigarettes, oriented horizontally, for three minutes. The loose tobacco is collected and weighed.

Thus, it may be seen from the above data that for cigarettes of approximately the same weight (columns 1 and 2), a cigarette with adhesive foam applied has greater firmness, greater coal strength, and fewer loose ends. Comparing columns 1 and 3, it is seen that a lighter cigarette with adhesive foam applied has approximately the same firmness as a conventional cigarette, with approximately the same coal strength but significantly fewer loose ends.

Figure 6:
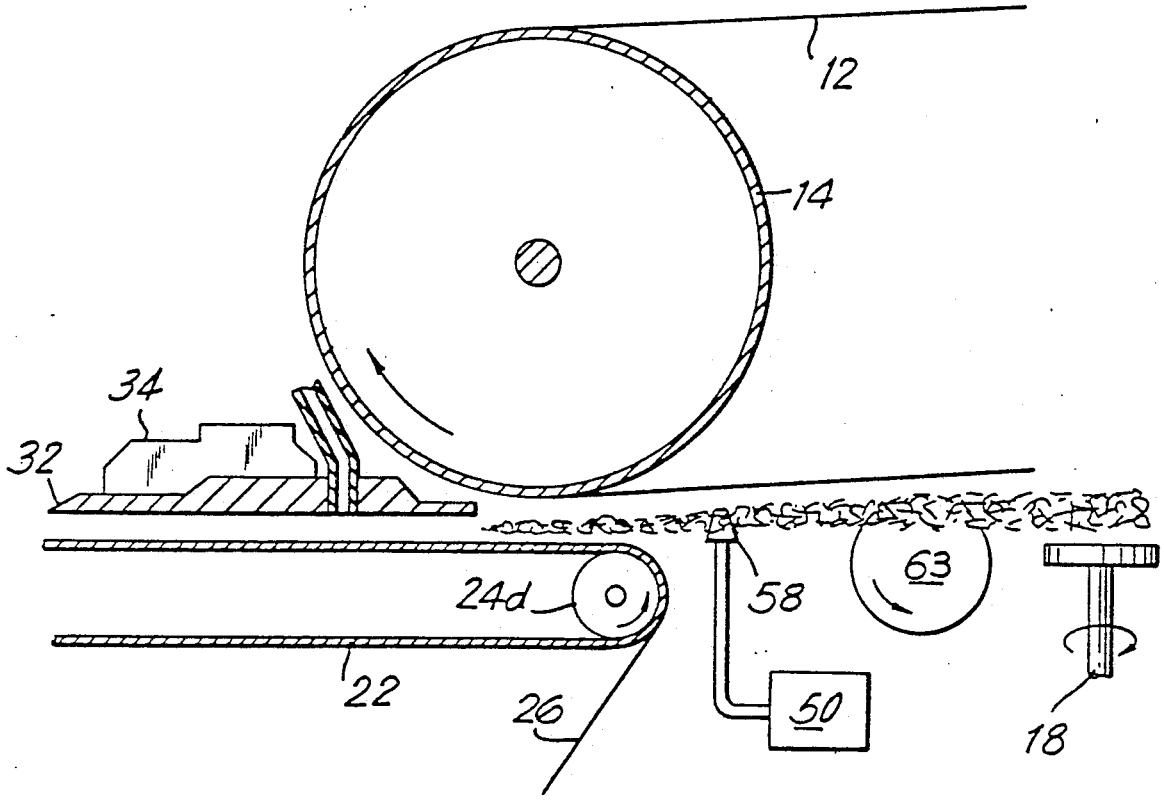
FIG. 6 is a vertical cross-sectional view of the ecreteur section of a cigarette making machine according to a third embodiment of the invention.

FIG. 6 shows a third method of adding foamed material to tobacco. In this method, splitter blade 63 turns in the direction shown at a speed such that the linear velocity of the outer edge of blade 63 is greater than or equal to the speed of tobacco conveyed on vacuum belt 12 at the point of contact. Blade 63 opens the moving stream of tobacco for foamed material to be applied inside the tobacco bed from generator 50 through pipe 51 and nozzle 58. Additional foam may be added through compression foot 32.

Figure 7:
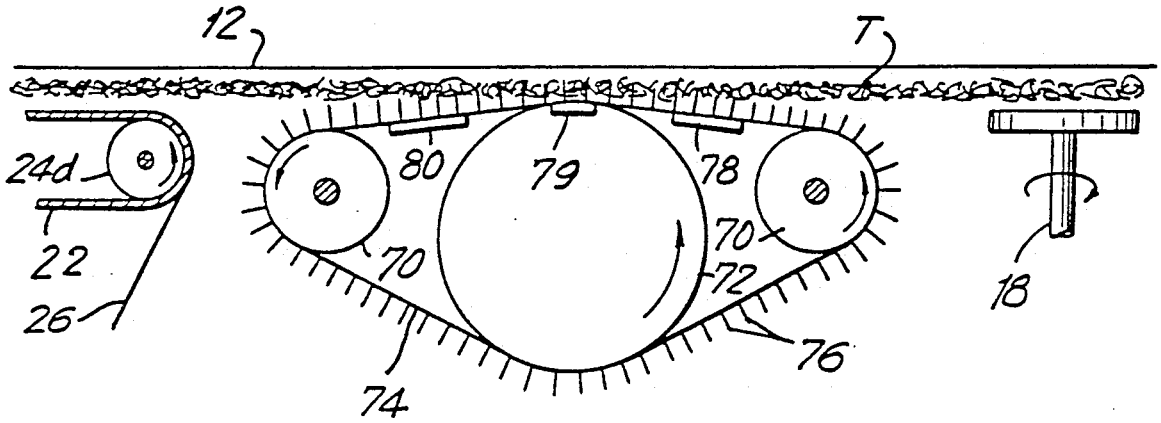
FIG. 7 is a vertical cross-sectional view of the ecreteur section of the cigarette making machine showing a fourth embodiment of the invention.

A fourth method of applying foamed material to the moving stream of tobacco is shown in FIG. 7. Conveyor belt 74 is moved in the direction shown so that needles 76 mounted on conveyor belt 74 penetrate the moving stream of tobacco downstream of ecreteur 18. Conveyor 74 is mounted for rotation on pulleys 70 and driven by drive wheel 72. Foamed material is supplied to the tobacco through needles 76 at reservoir 78. Additional foamed material may be applied through needles 76 at reservoir 79, thus applying foam to the moving belt of tobacco at different depths. Air reservoir 80 supplies air or other gas for blowing through needles 76 in order to clear the needles of any foam. Reservoirs 78, 79 and 80 do not rotate with belt 74.

Figure 8:
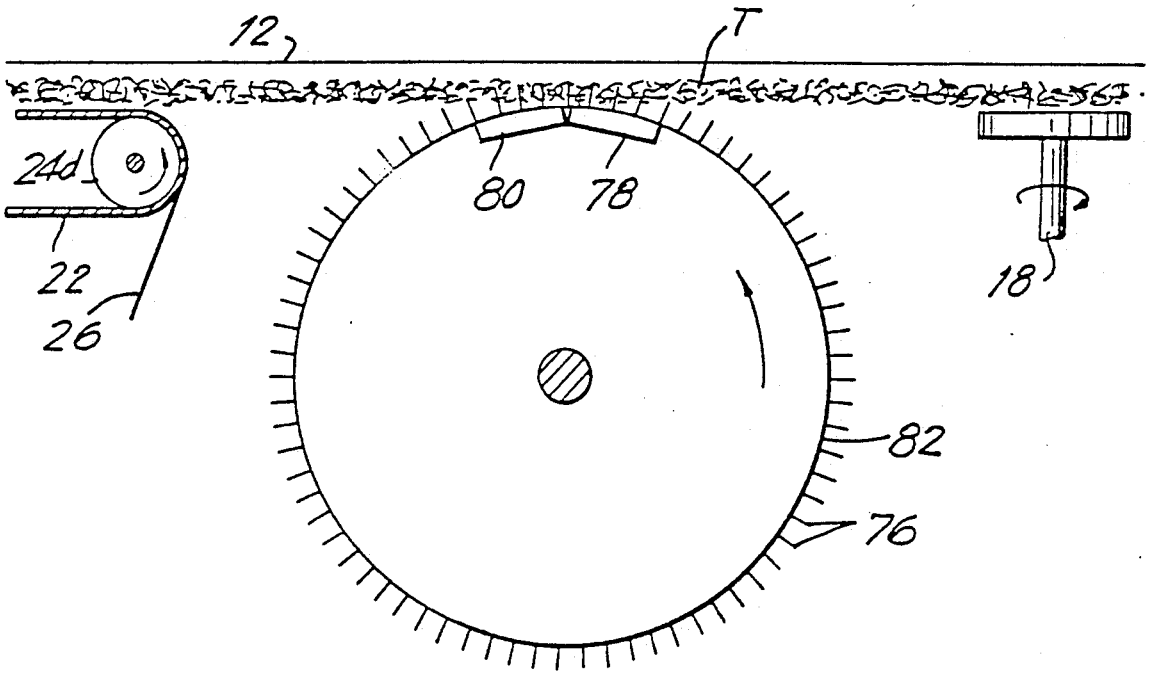
FIG. 8 is a vertical cross-sectional view of the ecreteur section of the cigarette making machine according to a fifth embodiment of the invention.

FIG. 8 shows a fifth method of applying foamed material to a moving bed of tobacco downstream of ecreteur 18. In this embodiment, needles 76 are mounted on revolving nozzle 82. Foamed material is supplied to the tobacco through needles 76 from reservoir 78. Air reservoir 80 supplies gas to clean the nozzles. Reservoirs 78 and 80 do not rotate with nozzle 18.

Figure 9:
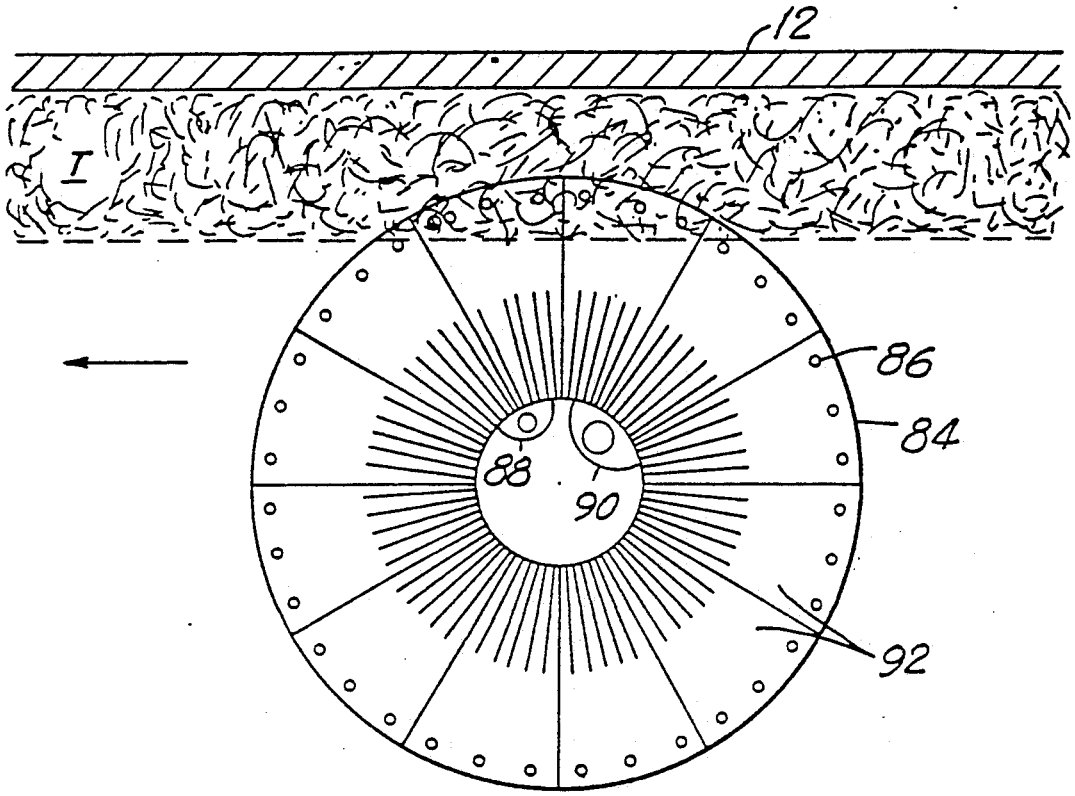
FIG. 9 is a vertical cross-sectional view of the ecreteur section of a cigarette making machine according to a sixth embodiment of the invention.
Figure 10:
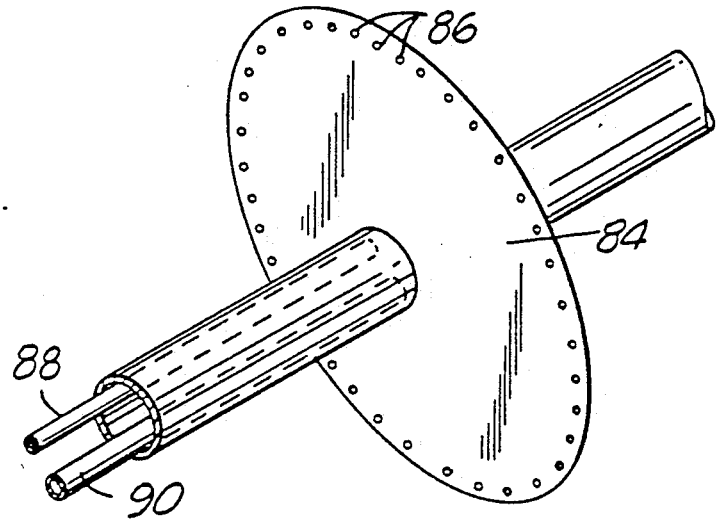
FIG. 10 is a perspective view of the cutting wheel shown in FIG. 9.

FIG. 9 shows a cross-sectional view of the ecreteur section of a cigarette making machine according to a sixth embodiment of the invention. Cutting wheel 84, located downstream of ecreteur 18, rotates in the direction indicated at a speed such that the outer perimeter rotates faster than the linear velocity of tobacco suspended from vacuum belt 12. Foamed material is supplied to zones 92 from foam pipe 90 as cutting wheel 84 rotates. Air is supplied through pipe 88 to cleanse wheel 84 of excess foam. Pipe 90 and air pipe 88 are fixed in position and thus are exposed to different zones as wheel 84 rotates. The size of the zones 92 supplied by pipes 90 and 88 may vary and the relative position of the pipes may vary depending on the speed of the cutter wheel. The foamed material passes through zones 92 and leaves wheel 84 through openings 86. In this arrangement, the foamed material is supplied to the moving stream of tobacco along its approximate center line before the tobacco is deposited on paper 26 for forming into a rod. FIG. 10 shows cutting wheel 84 in perspective.

Figure 11:
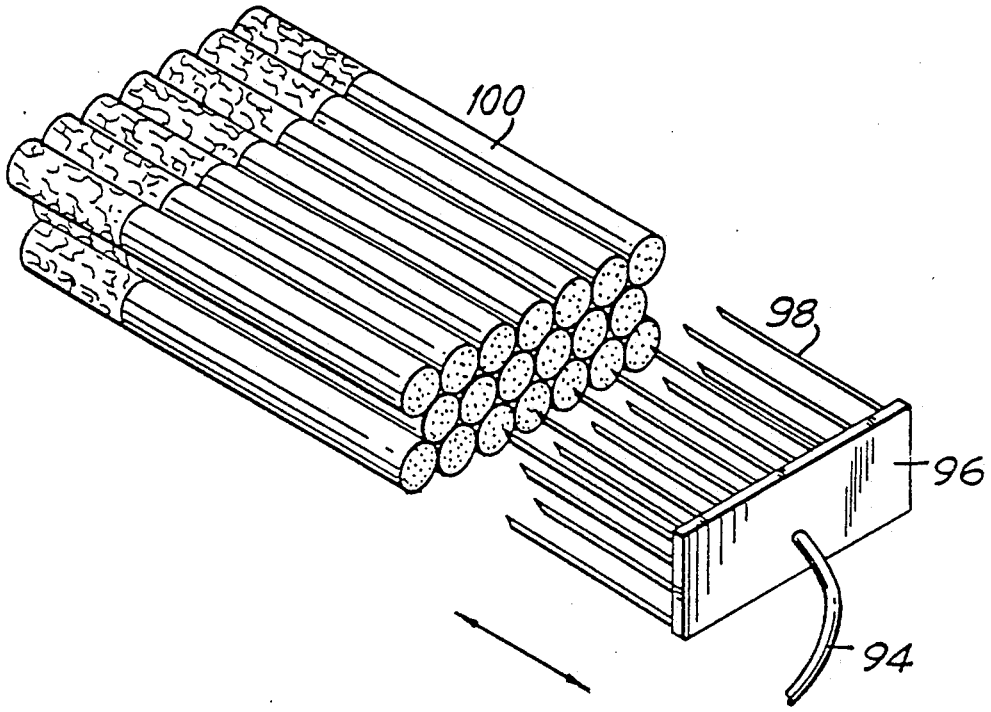
FIG. 11 is a perspective view of a seventh embodiment of the invention for introducing foamed material prior to packing groups of cigarettes in packages.

FIG. 11 shows a perspective view of apparatus for supplying foamed material to a finished cigarette prior to incorporating the cigarettes into a package. Foamed material is supplied through pipe 94 to header 96 and through needles 98. The needles 98 along with header 96 are moved in unison so that the needles 98 enter the group of cigarettes 100 along the approximate center lines of the cigarette. The foam is applied to the cigarettes as the needles are withdrawn from the cigarettes so that a uniform application is made along the rod of each cigarette on its approximate center line. This results in foamed material being applied near the very last stage of the manufacturing process. The method is also particularly useful when the material supplied is of a highly volatile nature such as, for example, menthol. Thus, the cigarettes are enclosed in an essentially airtight package immediately after insertion of the material with little chance for the material to be lost due to evaporation.

As discussed above, there are various ways that foam may be applied to a moving bed of tobacco or to finished cigarettes. In addition to the methods shown, the foamed material, whether adhesive or any other material, may be applied to the finished cigarette at any point after the cigarette leaves the cigarette maker until it is inserted into a cigarette package. Further, the foamed material may be applied to the tobacco filler at any convenient point in the manufacturing process, even prior to reaching the cigarette making machine.

After the foamed material has been added to the tobacco filler, it is preferable to dry and set the foam, evaporating the liquid or solvent contained in it. As discussed above, drying reduces the cigarette wrapper staining that can be caused even by the small amount of liquid or solvent in the foam. In addition, if a particular final moisture level is desired, drying allows the addition of more additive while achieving the same final moisture level. Setting the foam optimizes its firmness-improving abilities.

Four embodiments of apparatus according to this invention which is adapted to dry and set the foamed material after application to the tobacco filler are shown in FIGS. 12–15.

Figure 12:
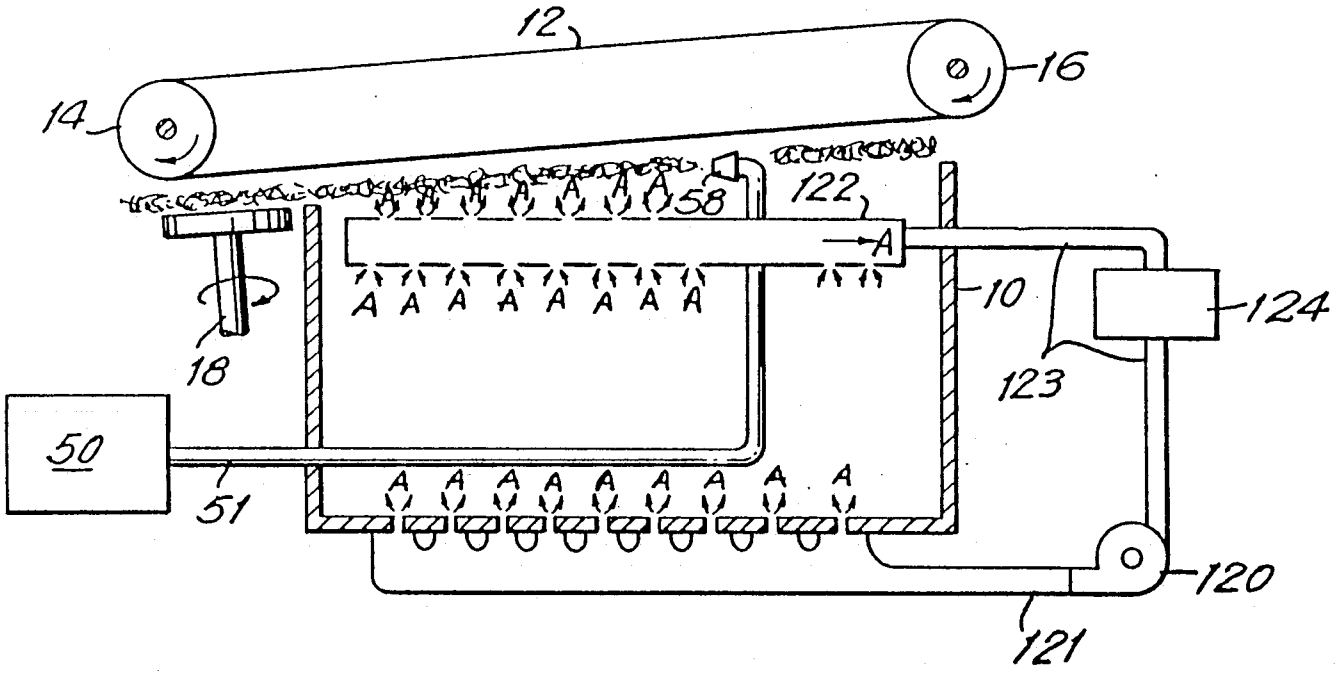
FIG. 12 is a vertical cross-sectional view of the apparatus of FIG. 5, modified for drying and setting applied liquid additive foam.
Figure 13:
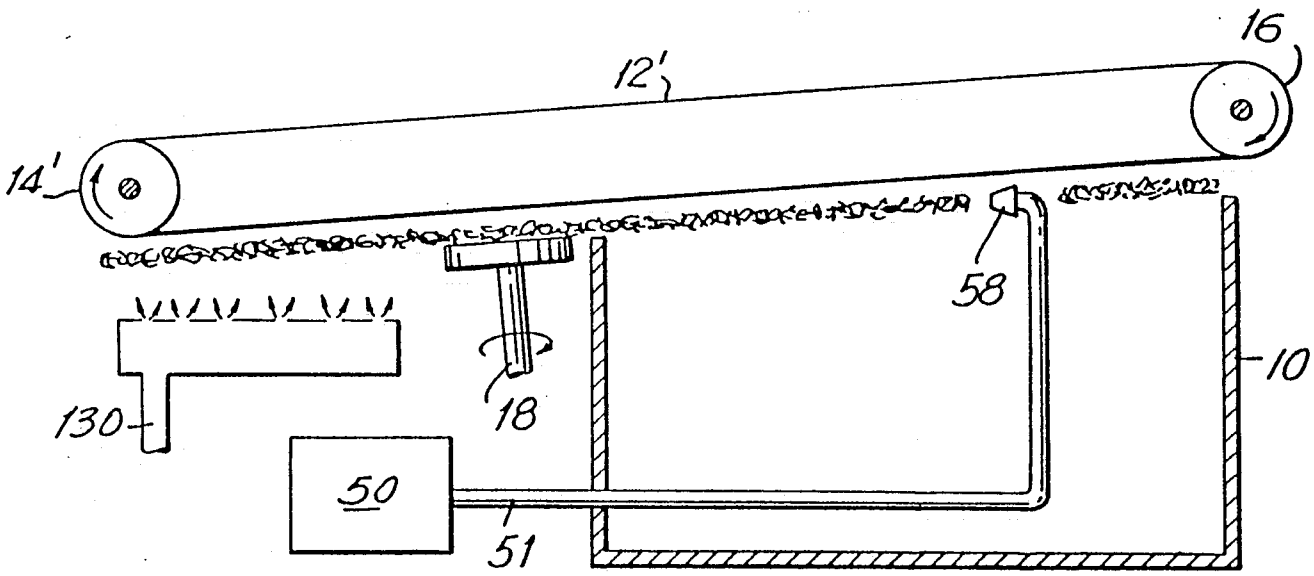
FIG. 13 is a vertical cross-sectional view of the apparatus of FIG. 5, modified in a second way for drying and setting applied liquid additive foam.

The embodiments shown in FIGS. 12 and 13 use conditioned forced air to dry and set the foamed material. The conditioned air is heated to a temperature appropriate to dry and set the particular foamed material being used and is humidified to prevent overdrying or toasting of the tobacco filler. Alternatively, the conditioned air can be ambient temperature air at ambient or reduced humidity.

In the embodiment of FIG. 12, the drying and setting takes place in chimney 10 of cigarette maker 8. Cigarette maker 8 normally includes a fan 120 which supplies air through conduit 121 to chimney 10 to transport the tobacco filler. The air is removed by manifold 122 and returned to fan 120 by conduit 123. By interposing conditioner 124 in conduit 123, the air stream in chimney 10 can be heated and humidified to the proper levels, or otherwise conditioned, and then a portion of the conditioned air can be allowed to impinge on the tobacco filler held by vacuum belt 12 downstream of foam-applying nozzle 58. The air flow in chimney 10 is illustrated by arrows A.

In the embodiment shown in FIG. 13, vacuum belt 12' extends beyond ecreteur 18, running over rollers 14', 16, and garniture tape 22 (not shown) does not begin until the end of vacuum belt 12'. A supply 130 of air, conditioned as described above, provides a flow of air for drying and setting the foamed material between ecreteur 18 and garniture tape 22. Air supply 130 can come from fan 120 or could be a separate supply.

The embodiments of FIGS. 12 and 13, which rely on heated or conditioned air to perform the drying and setting of the foamed material, may result in proper drying and setting of the outer layers of the mass of tobacco filler exposed to the air, but, even with conditioning of the relative humidity level of the air, may result in overdrying or toasting of those outer layers if the process is continued until the interior of the mass is also dried and set. This results, in particular, from the tendency of the foamed material, while wet, to accumulate at the crossover points between tobacco shreds in the interior of the mass of tobacco filler. Therefore, in the embodiments of FIGS. 14 and 15, the foamed material added to the tobacco filler is dried and set by exposing it to microwave radiation, which reaches and heats moisture in foamed material within the tobacco mass at essentially the same time that it reaches and heats the moisture in foamed material in the outer layers of the tobacco mass.

Figure 14:
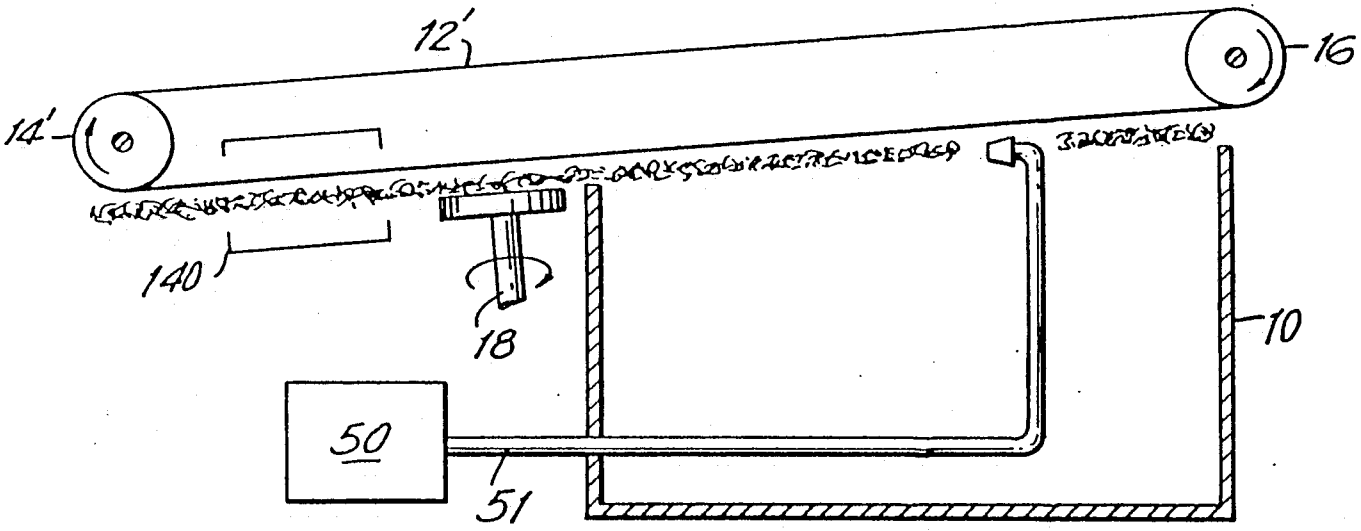
FIG. 14 is a vertical cross-sectional view of the apparatus of FIG. 5, modified in a third way for drying and setting applied liquid additive foam.

As in FIG. 13, vacuum belt 12' extends in the embodiment of FIG. 14 beyond ecreteur 18, running over rollers 14', 16, and garniture tape 22 (not shown) does not begin until the end of vacuum belt 12'. The section of vacuum belt 12' between ecreteur 18 and garniture tape 22 passes through a microwave cavity 140, so that the tobacco filler containing the wet foamed material is exposed to microwave radiation as it passes through cavity 140, drying and setting the foamed material. The power level of the microwave radiation is set based on the speed of vacuum belt 12' and the total amount of energy required to adequately dry and set the foamed material. For example, if 480 watt-seconds of energy are required, and belt 12' moves at 400 feet per minute, then if microwave cavity 140 has a length of 0.4 feet, so that tobacco transits cavity 140 in 0.06 seconds, the power level should be set to 8000 watts.

Figure 15:
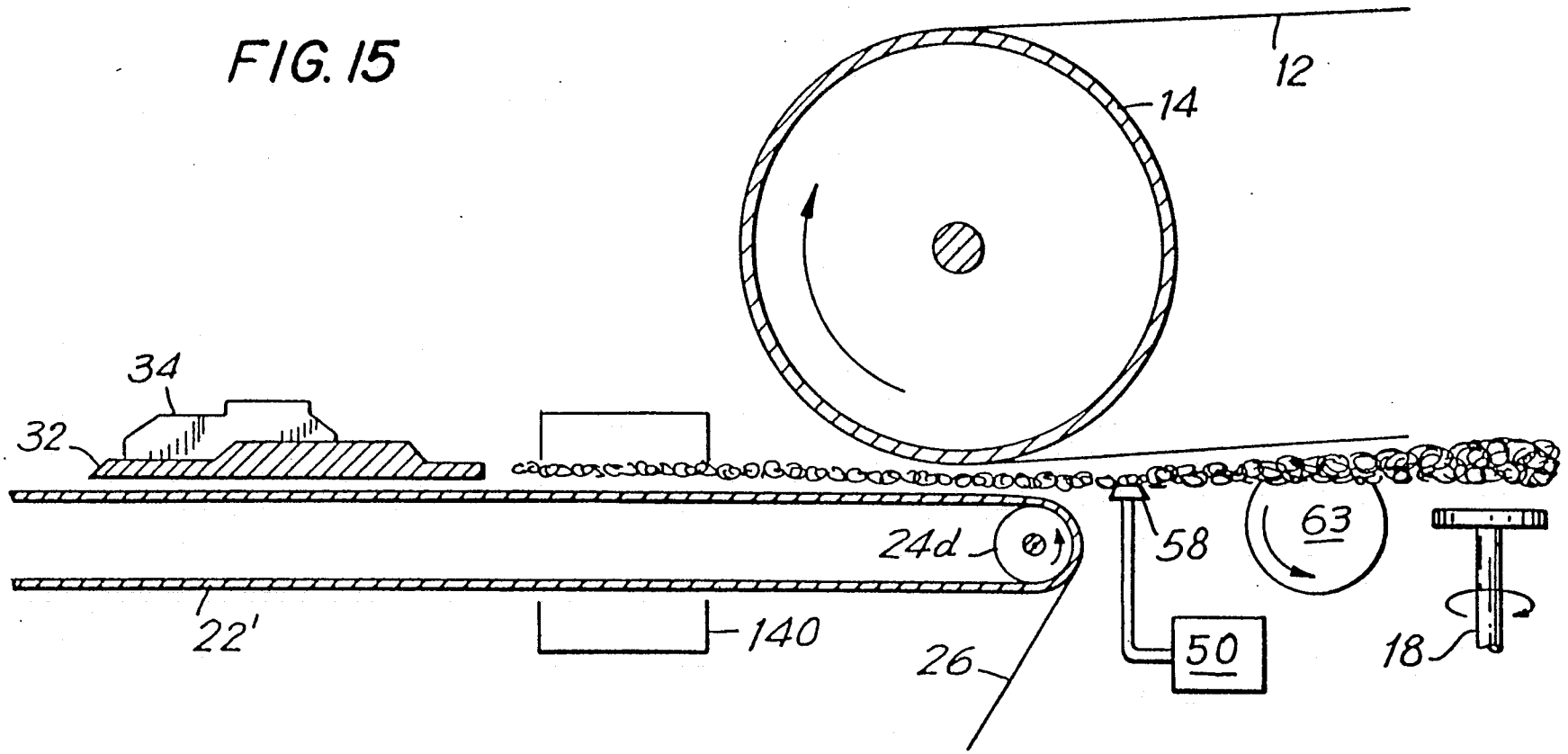
FIG. 15 is a vertical cross-sectional view of the apparatus of FIG. 6, modified for drying and setting applied liquid additive foam.

Alternatively, as shown in FIG. 15, microwave cavity 140 can be positioned around garniture tape 22' after the end of vacuum belt 12 and before short tongue 30, which is moved further downstream from the end of vacuum belt 12 as compared to its position in the embodiment of FIG. 6. The power level and length of microwave cavity 140 are determined in this case based on the speed of garniture tape 22', rather than that of the vacuum belt.

Figure 16:
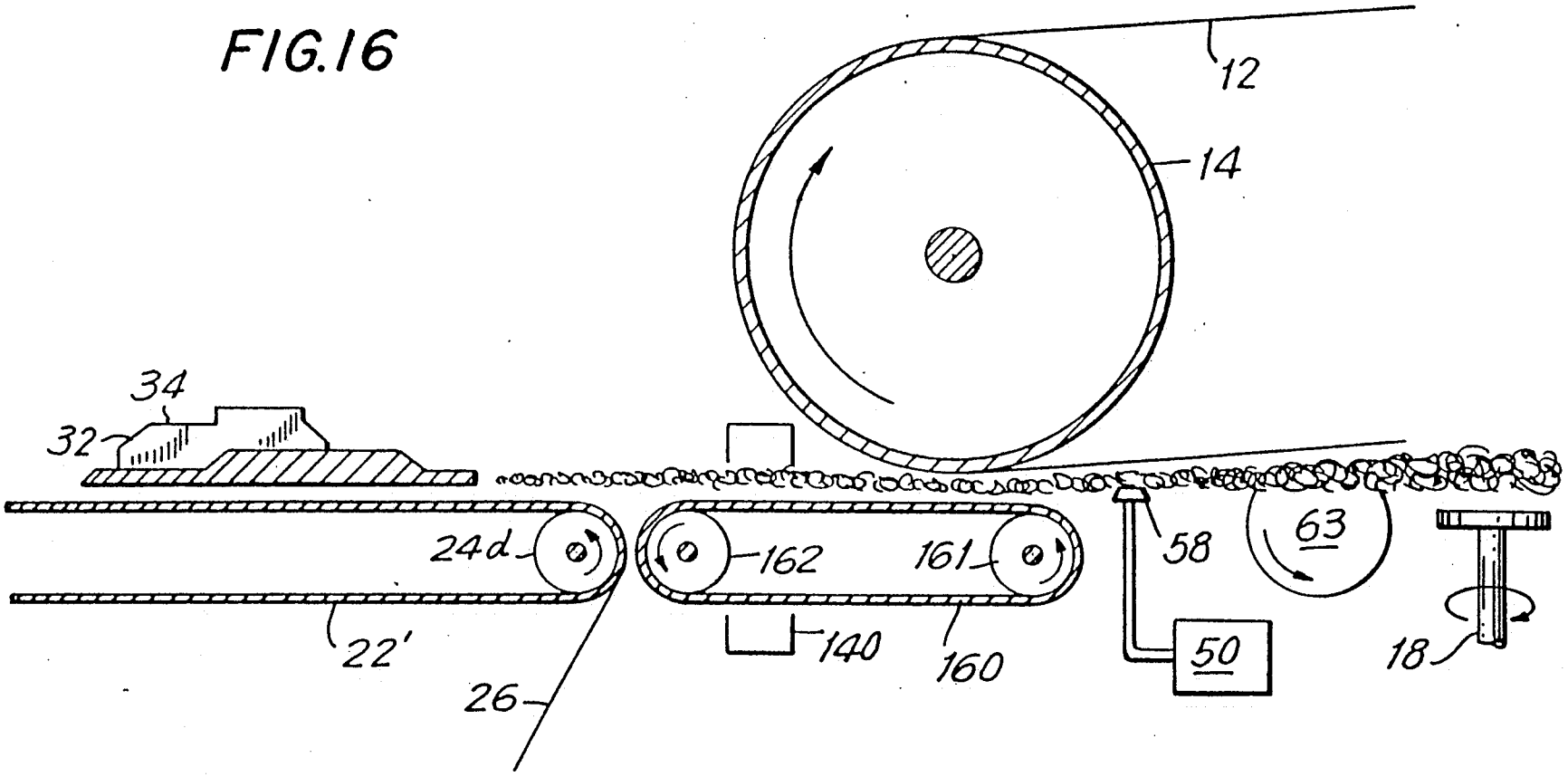
FIG. 16 is a vertical cross-sectional view of the apparatus of FIG. 6, with an alternative modification for drying and setting applied liquid additive foam.

In the embodiment of FIG. 15, the tobacco filler containing the still-wet foamed material contacts paper 26 before it is dried. Depending on the nature of the particular foamed additive and how wet it is, that may cause some staining of paper 26. In most cases it is unlikely that there will be significant staining, because the filler is simply resting on paper 26 and is not being compressed by having paper wrapped around it, and because the filler contacts the paper for only a short time before it is dried. However, in cases where such staining would be of concern, an arrangement such as that shown in FIG. 16 can be used. In FIG. 16, additional belt or tape 160, running around rollers 161, 162, is interposed between vacuum belt 12 and garniture tape 22', carrying tobacco filler between them. As in FIG. 15, paper 26 is introduced at garniture tape 22'. However, in this embodiment microwave cavity 140 is positioned around belt 160, so that the drying has taken place by the time the tobacco filler contacts paper 26.

Because it is desirable that the microwave energy be used to dry and set the foamed material as efficiently as possible, and to prevent damage to microwave cavity 140, the embodiments of FIGS. 14, 15 and 16 should be constructed so that only microwave-compatible materials pass through microwave cavity 140. By microwave-compatible is meant microwave transparent, i.e., neither microwave-absorptive nor microwave-reflective. The use of microwave-absorptive materials would waste energy because energy that would otherwise be used to dry and set the foamed material would be absorbed by other materials in the cavity. The use of microwave-reflective materials, particularly metals, would cause internal reflections of microwave energy within cavity 140 which could damage the cavity.

In particular, in the embodiment of FIG. 14 vacuum belt 12 should be nonmetallic. In addition, at least that portion of belt guide 62 (not shown in FIG. 14) which passes through cavity 140 should also be nonmetallic. In the embodiment of FIG. 15, garniture tape 22', and at least that portion of garniture 20 (not shown in FIG. 15) passing through cavity 140, should be nonmetallic. In the embodiment of FIG. 16, belt 160 should be nonmetallic. In any of these three embodiments, the nonmetallic material used is preferably microwave-transparent (nonabsorptive) as well.

One skilled in the art will appreciate that the present invention can be practiced by other than the described embodiments, which are presented for purposes of illustration and not of limitation, and the present invention is limited only by the claims which follow.

What is claimed is:

1. Apparatus for manufacturing cigarettes, said apparatus comprising:

a cigarette maker having means for providing a moving stream of tobacco, said maker including an inlet chimney for receiving cut tobacco filler, an ecreteur section, and a garniture, movable garniture tape and short tongue for forming said filler into a cigarette rod;

means for producing a liquid additive foam;

means for applying said liquid additive foam to said moving stream of tobacco; and means for drying and setting said applied liquid additive foam.

2. The apparatus of claim 1 wherein said drying and setting means comprises means for heating said applied liquid additive foam.

3. The apparatus of claim 2 wherein said heating means comprises means for contacting said filler and said applied liquid additive foam with a heated fluid.

4. The apparatus of claim 3 wherein said fluid is air.

5. The apparatus of claim 2 wherein said heating means comprises means for exposing said filler and said applied liquid additive foam to microwave radiation. 1

6. A method for manufacturing cigarettes, said method comprising:

providing a moving stream of tobacco;

producing a liquid additive foam;

applying said liquid additive foam to said moving stream of tobacco; and drying and setting said applied liquid additive foam.

7. The method of claim 6 wherein said drying and setting step comprises heating said applied liquid additive foam.

8. The method of claim 7 wherein said heating step comprises contacting said filler and said applied liquid additive foam with a heated fluid.

9. The method of claim 8 wherein said contacting step comprises contacting said filler and said applied liquid additive foam with heated air.

10. The method of claim 7 wherein said heating step comprises exposing said filler and said applied liquid additive foam to microwave radiation.

* * * * *

UNITED STATES PATENT AND TRADEMARK OFFICE

CERTIFICATE OF CORRECTION

PATENT NO. : 5,012,823

DATED : May 7, 1991

INVENTOR(S) : Gus D. Keritsis et al.

It is certified that error appears in the above-identified patent and that said Letters Patent is hereby corrected as shown below:

Column 2, line 61 "tabacco" should be -- tobacco --.

Column 4, line 27, "charides" should be
-- and resins selected from the class of polysaccharides --;

line 52, "numberal" should be -- numeral --.

Claim 5, column 11, line 3, "1" should be deleted.

Signed and Sealed this

Thirtieth Day of November, 1993

*Attest:*

*Attesting Officer*

Bruce Lehman

BRUCE LEHMAN

*Commissioner of Patents and Trademarks*